United States Patent [19]

Goyer et al.

[11] 3,970,403

[45] July 20, 1976

[54] ANISOTROPIC ROAD SURFACE

[75] Inventors: André Goyer, Lillebonne; René Smadja, Notre Dame de Gravenchon, both of France

[73] Assignee: Mobil Oil Corporation, New York, N.Y.

[22] Filed: Apr. 18, 1975

[21] Appl. No.: 569,415

Related U.S. Application Data

[63] Continuation-in-part of Ser. No. 390,278, Aug. 21, 1973.

[30] Foreign Application Priority Data

June 1, 1973 France ..... 73.20091

[52] U.S. Cl. ..... 404/27; 404/82

[51] Int. Cl.[2] ..... E01C 3/00

[58] Field of Search ..... 404/27, 20, 82, 80, 404/81, 31

[56] References Cited

UNITED STATES PATENTS

| | | | |
|---|---|---|---|
| 465,650 | 12/1891 | Wilkinson | 404/27 |
| 814,797 | 3/1906 | McDonald | 404/27 |
| 918,156 | 4/1909 | Hutchinson | 404/27 |
| 1,747,125 | 2/1930 | Murphy | 404/27 X |
| 2,220,149 | 11/1940 | Finley | 404/82 |
| 2,925,831 | 2/1960 | Welty | 404/82 X |
| 3,112,681 | 12/1963 | Gessler | 404/82 X |

*Primary Examiner*—Nile C. Byers, Jr.
*Attorney, Agent, or Firm*—Charles A. Huggett; Raymond W. Barclay; Dennis P. Santini

[57] ABSTRACT

An anisotropic road surface is provided comprising a road-bed having superimposed thereon a mastic binder, upon which is superimposed a layer of coated gravel particles, characterized by the fact that by close contact between the gravel particles in a particular direction, maximum resistance of the road-surface to crushing is obtained and wherein, by insertion of the mastic binder between at least a portion of the gravel particles, deformability of the finished road-surface is obtained in a perpendicular direction.

8 Claims, 1 Drawing Figure

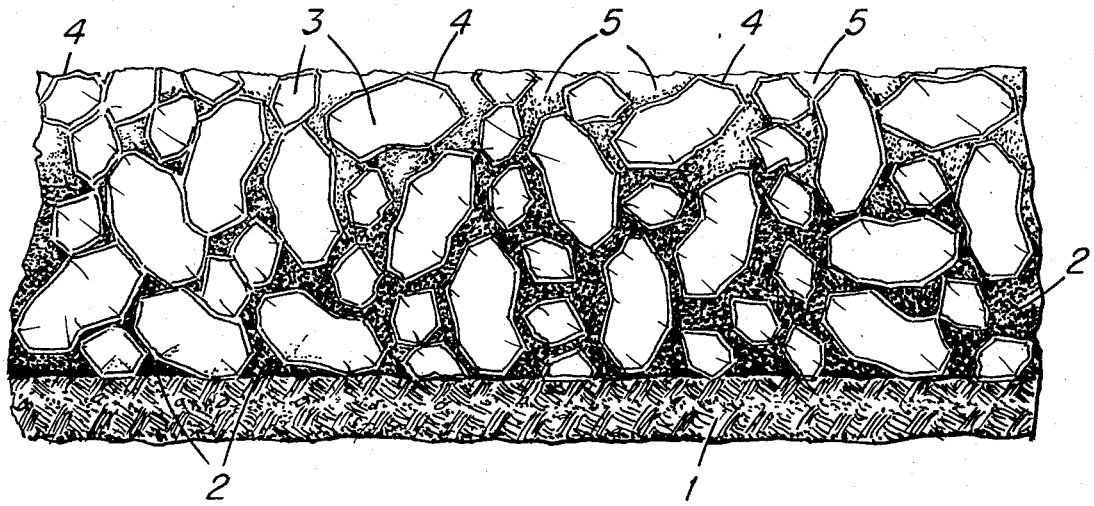
FIG.

ANISOTROPIC ROAD SURFACE

CROSS REFERENCE TO RELATED APPLICATIONS

This is a continuation-in-part of U.S. application Ser. No. 390,278 filed Aug. 21, 1973.

Convention application of Application No. 73 2009 1, filed June 1, 1973, in France, priority for which is claimed.

BACKGROUND OF THE INVENTION

1. Field of the Invention

This invention relates to an anisotropic road surface and a method of preparation thereof. More particularly, the invention relates to a road surface which is anisotropic in behavior (i.e., exhibiting different properties when tested along axes in different directions), as compared with road surfaces which are isotropic in behavior (i.e., having the same properties in all directions).

2. Description of the Prior Art

Prior to the present invention, various processes have been proposed for the construction of road surface courses. One of the most recent proposals consists of prefabricating the surface by mixing hot asphalt with an inert filling material, the particles of which are between 0.1 mm and 14 mm, for example, and then spreading the hot mixture thus obtained on a suitably prepared road surface. Such process has been found to lead to the production of a surface course having, to a sufficient degree, isotropic properties, i.e., properties which are the same whether measured in the direction of the thickness of the surface course or along an axis parallel to the surface of the course.

U.S. Pat. Nos. 1,834,835 and 1,918,155 show isotropic road surface preparations. A detailed analysis of the desirable properties for such a surface course and the stresses to which the surface course will be subjected, leads to the conclusion that it is desirable to have a surface course presenting anisotropic mechanical properties, i.e., mechanical resistance which is as large as possible in the direction of the thickness of the surface course, and a certain deformability in all perpendicular directions.

SUMMARY OF THE INVENTION

The present invention is directed to an anisotropic road surface comprising a road-bed, a mastic binder superimposed upon said road-bed consisting essentially of asphalt containing from about 10 to about 60 percent by weight of an inert filler having particle dimensions not greater than about 100 microns and a layer of gravel particles superimposed upon said mastic binder, said particles being coated with a material which serves to assure close contact between said particles, but wherein spaces between the particles are not entirely filled by said binder, the dimensions of said particles being from about 2 mm to about 25 mm with the difference between the smallest and largest particles being no more than about 8 mm, the quantity of coated particles employed being such that after compaction the mastic binder fills the interstitual spaces between the particles of gravel to a thickness of from about 50 to about 95 percent of the total thickness of the final road surface. The anisotropic road surface of this invention is characterized by the fact that by close contact between the gravel particles in a particular direction maximum resistance of the road surface to crushing is obtained and wherein by insertion of the mastic binder between at least a portion of the gravel particles, deformability of the finished road surface is obtained in a perpendicular direction. The above-described anisotropic road surface, possessing certain well-defined anisotropy in its properties, is especially useful for such purposes as road construction, artificial works and highways.

The present invention is further directed to a process for preparing an anisotropic road surface which comprises superimposing on a road-bed at least a 2 mm layer of mastic binder consisting essentially of from about 10 to about 60 percent by weight of an inert filler having particle dimensions not greater than about 100 microns, superimposing upon said layer of mastic binder a layer of gravel particles coated with a coating material which serves to assure close contact between said particles while leaving interstitial spaces therebetween, the dimensions of said particles being from about 2 mm to about 25 mm with the difference between the smallest and largest particles being no more than about 8 mm and thereafter compacting the layer of gravel particles in a direction perpendicular to the surface of said road-bed until the mastic binder fills the interstitial spaces between the particles of gravel to a thickness of from about 50 to about 95 percent of the total thickness of the final road surface.

Characteristic of the novel anisotropic road surface of the present invention is that its surface is rough since it is formed of gravel particles attached to each other by the coating material wherein the spaces between the particles are not entirely filled by the binder. The process for fabricating the anisotropic road surface of this invention is characterized by the fact that the road-bed surface to be covered is coated by a layer of mastic binder having a thickness of at least 2 mm. Thereafter on this binder layer there is deposited a layer of coated gravel whose particles have dimensions of from 2 mm to 25 mm. The difference between the smallest and the largest particles of the gravel being no more than 8 mm, and the particles of gravel are inserted in the layer of mastic binder so as to obtain compaction of the particles throughout the thickness of the mastic layer. The quantity of coated gravel particles employed is such that after compaction the mastic binder fills the interstitial spaces between the particles of gravel to a thickness of from 50 to 95% of the total thickness of the final road surface.

As a mastic binder, any known binder normally usable in the road construction industry can be employed. Preferred, however, are asphalts, and more particularly a filled asphalt containing from 10 to 60%, by weight, with reference to the mixture of asphalt and filler, of at least an inert filler whose particles have dimensions not greater than 100 microns.

One of the critical characteristics of the anisotropic road surfaces of the present invention resides in the choice of the granulometry of the particles of gravel employed. In the prior art, as previously described, particles whose dimensions vary between 0.1 mm and 14 mm, for example, are added to the binder, which may be an asphalt. Stated in another manner the gravel particles heretofore employed may be said to present the following relationship:

$$R = \frac{\text{apparent density}}{\text{actual density}} \times 100$$

having a value from 90 to 95%. Employing such gravel particles, whose granulometric distribution is very large, surface courses having isotropic properties were heretofore obtained. In accordance with the present invention, on the other hand, gravel is employed whose particles have dimensions from 2 mm to 25 mm, but in which, in a specific surface course, the difference between individual gravel particles will not be greater than 8 mm. Thus, for example, the gravel employed may comprise particles which do not pass through a sieve having meshes of 2 mm, but which do pass through a sieve having meshes of 10 mm × 10 mm. For such gravel the relationship R, defined above, is of the order of 70%. Furthermore, in accordance with the invention gravel particles may be employed for which this relationship is between 60 and 80%.

The gravel particles employed in accordance with the present invention are first coated by means of a binder of commercially available types, and in accordance with conventional coating procedures. This binder may, for example, comprise asphalt or filled asphalt, provided that the filler comprises particles whose dimensions are not greater than 100 microns. This coating, one of whose functions is to assure a close contact between the particles of gravel when they are not entirely surrounded by mastic binder, may comprise from about 2 to 15% of the weight of the gravel.

Another important characteristic of the anisotropic road surface of the present invention resides in the process employed for its manufacture. Upon a layer of mastic binder a layer of gravel is deposited and compacted in a direction perpendicular to the surface of the surface course until its particles penetrate into the binder throughout its thickness. In this manner, it will be noted that in a direction perpendicular to the surface course, the various gravel particles are practically touching, which confers upon the surface course obtained a very large resistance to crushing in this direction. On the other hand, throughout at least a certain thickness of the surface course, a layer is formed in which a specific proportion of mastic binder has penetrated between the particles of gravel, with the result that this layer presents a substantial deformability in a direction parallel to the surface of the surface course. It will thus be apparent why the resulting surface course exhibits anisotropic properties depending upon the direction in which these properties are measured.

The final anisotropic road surface obtained can vary in thickness. Its minimum thickness can be approximately 8 to 10 mm, and its maximum thickness can attain 6 cm or more. In essence, the improved road surface is in the form of two layers of different composition. The lower layer is formed of particles of gravel, very well compacted in the vertical direction, but in which the interstices among the particles are filled by the mastic binder. The upper layer is comprised essentially of particles of coated gravel between which certain empty spaces exist.

In many instances the lower layer represents from 50 to 95% of the total thickness of the surface course. It should be noted that, in accordance with the present invention, it is also possible to construct the surface course directly on any infrastructure. Also, panels of the surface course can be fabricated in a factory and thereafter put into place, if so desired.

BRIEF DESCRIPTION OF THE DRAWING

The FIGURE of the accompanying drawing, illustrative of the structure of the anisotropic road surface of the present invention, shows a cross-sectional view of such a road surface.

In the FIGURE, a road-bed 1 is shown with a mastic binder 2 superimposed upon said road-bed 1 and with a layer of gravel particles 3 superimposed upon said mastic binder 2. The gravel particles 3 are coated with a material 4 which serves to assure close contact between said particles 3. The spaces between the particles 3 are filled with mastic binder 2 to a thickness measured from the road-bed 1 of from 50 to 95 percent of the total road surface thickness. The remaining spaces 5 between the particles 3 are not filled with mastic binder 2.

DESCRIPTION OF SPECIFIC EMBODIMENTS

In order to provide a better understanding of the improvement realized in the anisotropic road surface of the present invention, and the method for its preparation, the following example is presented. The example is not intended to be limiting and various modifications thereof can be employed, as will be readily apparent to those skilled in the art.

As a binder, an asphalt is employed having a penetration at 25°C of 25 and a softening point of 75°C. To this asphalt is added a mineral filler comprising limestone particles whose largest dimension is not more than 100 microns. This filler is employed in an amount of about 30%, by weight, with reference to the final mixture of asphalt and filler employed. In addition, a mixture comprising substantially equal parts of the same asphalt and the same filler is employed to coat the gravel, whose particles have dimensions of between 2 and 6 mm. The amount of the coating material, by weight, with reference to the gravel is about 10%.

A layer of hot mastic binder, as hereinbefore described, is deposited in a metal mold. The thickness of this layer is 4 mm. After cooling a sufficient thickness of gravel, coated as hereinbefore described, is deposited on this layer. The entire composition is then compacted by means of a laboratory roller having a maximum weight of 80 kg. This compaction results in the particles of gravel penetrating to the bottom of the layer of mastic binder. Thus, a surface coating is obtained whose total thickness is 20 mm and which is formed of a lower layer whose thickness is approximately 15 mm and an upper layer whose thickness is about 5 mm.

After removal from the mold, the surface course panel is tested by means of a traffic simulator equipment. This equipment comprises a metal panel supported at three points. A heavy wheel is rolled back and forth over the surface of the paving placed on this panel. Under the influence of the passage of the wheel, the metal panel reveals, at certain points, a deflection reaching 3 mm.

By virtue of the foregoing test, an evaluation can be made of the rutting of the paving, which consists in determining after how many cycles of the wheel a permanent deformation (rut) of the paving occurs. Furthermore, tests of resistance to cracking of the paving can be made, which consists in determining after how many cycles cracks appear in the paving.

When conventional isotropic road surface paving is employed, as shown in the heretofore mentioned art, it is found that this surface test can only be made for about 2000 cycles. Employing such conventional paving, the advantages which could be desired with respect to one of the properties (e.g. resistance to rutting) are compensated for by losses observed in another property. On a comparative basis, however, testing the paving of the present invention, it is observed that such paving can withstand, without rutting or cracking, more than 300,000 cycles.

While preferred embodiments of the novel anisotropic road surface of the present invention have been described for purposes of illustration, it will be understood that various modifications and adaptations thereof may be made without departing from the spirit of the invention.

What is claimed is:

1. An anisotropic road surface comprising a road-bed, a mastic binder superimposed on said road-bed consisting essentially of asphalt containing from about 10 to about 60 percent by weight of an inert filler having particle dimensions not greater than about 100 microns and a layer of gravel particles characterized by a relationship R of between 60 and 80%, R being $$\frac{\text{apparent density}}{\text{actual density}} \times 100,$$

superimposed on said mastic binder, said particles being coated with a material which serves to assure close contact between said particles, but wherein spaces between the particles are not entirely filled by said binder, the dimensions of said particles being from about 2 mm to about 25 mm with the difference between the smallest and largest particles being no more than about 8 mm, the quantity of coated particles employed being such that after compaction the mastic binder fills the interstitial spaces between the particles of gravel to a thickness of from about 50 to about 95 percent of the total thickness of the final road surface.

2. A road surface as defined in claim 1 wherein said coating material is an asphaltic material.

3. A road surface as defined in claim 1 wherein said coating material comprises from about 2 to 15% of the weight of the gravel.

4. The road surface as defined in claim 1 wherein said inert filler in said mastic binder comprises limestone particles.

5. A process for preparing an anisotropic road surface which comprises superimposing on a road-bed at least a 2 mm layer of mastic binder consisting essentially of asphalt containing from about 10 to about 60 percent by weight of an inert filler having particle dimensions not greater than about 100 microns, superimposing on said layer of mastic binder a layer of gravel particles characterized by a relationship R of between 60 and 80%, R being $$\frac{\text{apparent density}}{\text{actual density}} \times 100,$$

coated with a coating material which serves to assure close contact between said particles while leaving interstitial spaces therebetween, the dimensions of said particles being from about 2 mm to about 25 mm with the difference between the smallest and largest particles being no more than about 8 mm and thereafter compacting the layer of gravel particles in a direction perpendicular to the surface of said road-bed until the mastic binder fills the interstitial spaces between the particles of gravel to a thickness of from 50 to 95 percent of the total thickness of the final road surface.

6. The process of claim 5 wherein said coating material is an asphaltic material.

7. The process of claim 5 wherein said coating comprises from about 2 to 15% of the weight of the gravel.

8. The process of claim 5 wherein said inert filler in said mastic binder comprises limestone particles.

* * * * *